US005503287A

United States Patent [19]

Gammons et al.

[11] Patent Number: 5,503,287

[45] Date of Patent: Apr. 2, 1996

[54] LID AND STRUCTURAL ARRANGEMENT FOR RECYCLING AND REFUSE RECEPTACLES

[75] Inventors: David L. Gammons, Kempton, Pa.; Philip C. Haas, R.D. #2, Box 159, Kempton, Pa. 18529

[73] Assignee: Philip C. Haas, Kempton, Pa.

[21] Appl. No.: 213,367

[22] Filed: Mar. 14, 1994

Related U.S. Application Data

[63] Continuation of Ser. No. 857,379, Mar. 25, 1992, abandoned.

[51] Int. Cl.[6] ..... B65D 8/08; B65F 1/16

[52] U.S. Cl. ..... 220/4.11; 220/908; 220/352; 217/76; 217/88

[58] Field of Search ..... 220/352, 908, 220/401, 254, 210, 319, 4.11, 4.04, 4.05; 217/76, 51, 88

[56] References Cited

U.S. PATENT DOCUMENTS

| | | | |
|---|---|---|---|
| 402,679 | 5/1889 | Leggett . | |
| 1,087,138 | 2/1914 | Robinson | 217/51 |
| 1,146,714 | 7/1915 | Keen | 220/908 X |
| 1,237,016 | 8/1917 | Brown | 220/908 X |
| 1,692,287 | 11/1928 | Bundy | 220/254 |
| 2,031,153 | 2/1936 | Fessenden | 217/76 |
| 2,858,118 | 10/1958 | Perkins . | |
| 4,295,508 | 10/1981 | Metzger . | |
| 4,873,795 | 10/1989 | Spiess et al. . | |
| 4,878,590 | 11/1989 | Porter . | |
| 4,905,853 | 6/1990 | Strawder . | |

*Primary Examiner*—Allan N. Shoap
*Assistant Examiner*—Nathan Newhouse
*Attorney, Agent, or Firm*—Charles A. Wilkinson

[57] ABSTRACT

A cast aluminum structural ring into which is seated a cast aluminum top normally locked to the structural ring and secured by threaded-type fastenings to the upper portions of a slatted-type slanted top receptacle for recycled materials or refuse materials. The outside portion of the structural ring is provided with an angle which varies from portion to portion of the outside surface of the structural ring to conform it to the angle with which it meets the inside of the slats of the slatted receptacle when the structural ring is inserted into the receptacle at approximately the same angle as the slanted top of the receptacle. Preferably the outside of the structural ring and a further reinforcing ring are slightly inclined inwardly with respect to the vertical axis of the receptacle to provide a pleasing bow to the outward surface of the receptacle.

32 Claims, 6 Drawing Sheets

LID AND STRUCTURAL ARRANGEMENT FOR RECYCLING AND REFUSE RECEPTACLES

This application is a continuation of application Ser. No. 07/857,379, filed Mar. 25, 1992 now abandoned.

RELATED APPLICATIONS

This application is related to an application filed concurrently by the present inventors for a Design Patent entitled "Lid Design for Recycling and Refuse Receptacles".

BACKGROUND OF THE INVENTION (1) Field of the Invention

This invention relates broadly to the collection of recyclables and refuse and more particularly to the provision of durable tamper-proof public receptacles for recyclables and refuse. More particularly still, the present invention relates to an improved tamper resistant closure or lid for public receptacles as well as an improved structural arrangement for strengthening such receptacles when they are provided with a slatted exterior and a slanted top.

(2) Description of the Prior Art

During the last two or more decades the public collection of recyclables such as particularly cans of various compositions, glass bottles, plastics, paper products and other nominal waste materials and particularly waste packaging materials which can be recycled has come more and more to the fore. Public bodies such as municipalities, state and federal parks and other public bodies as well as corporate entities such as large companies and the like have undertaken to provide recycling and refuse receivers in public places to encourage the public to both dispose of their refuse and to aid in the collection of recyclables for further processing.

At one time the common public container for all kinds of waste materials was the ubiquitous heavy wire-mesh container. Such containers were fairly durable due to their heavy construction plus a certain degree of resiliency or bendability conferred by the open mesh wire construction. Such containers, however, have the disadvantage that the contents are exposed to public view and are frequently objectionable to many members of the public. In more recent years various solid containers such as, in many cases, concrete containers and the like have been substituted for the former wire-mesh containers, although wire-mesh containers are still used, particularly where aesthetics is not a factor. While such concrete and the like containers are fairly durable and in many cases, particularly when they have an exterior surface of small decorative stones or the like, not unattractive, they are in many cases both difficult to empty and also expensive. Generally solid containers made of thin coated metal or even durable plastic, including heavy plastic materials, are fairly economical and easy to handle, but objectionable to many people simply because they look like "garbage cans". They are also often subject to vandalism, since they can be easily picked up, knocked over and otherwise mishandled, in which case the metal tends to bend and flake off its coating, after which it becomes subject to corrosion. Plastic containers, in addition, can usually be fairly easily cracked or otherwise damaged when attacked by a determined vandal.

Within the last twenty years, a type of container having a decorative exterior composed originally of wood slats to give it a rustic appearance and more recently of plastic slats which look like wood or similar materials have come into use, particularly in upscale locations such as in shopping centers, public parks, the interior of large buildings and other places where it is desired to have a trash or recycling receptacle in plain sight, but the appearance of an ordinary trash receptacle or garbage can may be unacceptable. The provision of vertical wooden slats or artificial material slats having the appearance of wood over a cylindrical receptacle is particularly desirable because of the rustic appearance provided plus the ease of applying a vertical slat to the exterior of a cylindrical container, so long as the slat is maintained longitudinally aligned with the length of the cylinder. As indicated above, such receptacles have been in use for about two decades and have been extremely popular for about a decade. Such receptacles have been made in various ways including the attachment of the rustic slats on the outside of an ordinary trash can or barrel as well as the provision of a cylindrical shaped receptacle by the use of various internal supporting means such as structural rings and the like to reinforce the outer slats so that the combination of the slats and the rings forms their own receptacle. If adequately reinforced internally, such slated exterior ring-reinforced-type containers have proved reasonably strong and durable.

Within the last several years a new type of container or receptacle having a slated exterior has come into use. This type of container or receptacle is provided with a slanted top rather than a flat top resulting in a particularly attractive design. Furthermore, when such slatted receptacles are arranged around a central unifying post, a particularly attractive and aesthetically pleasing arrangement is provided. Such an arrangement is disclosed in U.S. Design patent application Ser. No. 07/222741 filed Jul. 22, 1988 abandoned Mar. 8, 1992, as well as in Divisional application Ser No. 07/847,815 filed Mar. 6, 1992, now U.S. Design Pat. No. D 331,824. The initial construction of the new slanted top slatted receptacles was effected by fastening slats with threaded fasteners to the exterior of an ordinary steel barrel with the fastenings passing into the external barrel hoops on such barrel. The internal steel barrel formed a strong construction for the container itself and the slatted exterior with differential length slats provided a pleasing appearance to the exterior. When a lid was desired, a flat lid was merely placed in the top supported by internal tabs spaced, usually at four locations, on the interior of the slats. The top could either be supported in a horizontal position or preferably was slanted to conform more or less with the top of the receptacle. Unfortunately, while the described arrangement provided a strong lower section to the receptacle, the upper slanted portion was left essentially unsupported, particularly with respect to the longer or higher slats and there was, furthermore, no satisfactory way to securely attach the top to the receptacle.

Consequently, while the slanted top-slatted recycling and refuse receptacles referred to above have become extremely popular, their configuration has resulted in several difficulties. One of these difficulties is that while an ordinary slatted-flat topped configuration is fairly easy to reinforce near the top by internal rings or other means, when the top is slanted, the longer slats on one side are difficult to reinforce and may, if attacked by a particularly determined vandal, become rather easily damaged.

A somewhat related difficulty has been that in these increasingly vandalism and scavenger prone times, certain uninhibited persons may rather frequently attempt to remove recyclable materials from the receptacles and also to strew any refuse about the surrounding environment. While, as explained above, tops have been used on the slanted top receptacles, it has been difficult to secure said tops to the receptacle itself or to close off the top to limit access to the interior thereof, because of the arrangement with relatively short slats on one side and relatively long slats on the other side and because the top is desirably arranged also in a slanted position.

Any top or lid, therefore, has usually been merely set into the top and supported upon tabs or knobs and the like extending from the inside of the slats. In other cases, the top, which usually has a hole in the center or close to the center, is secured directly by a screw fastening or the like through short tabs or peripheral flanges to the outer slats. The disadvantage of this, however, is not only that the arrangement is inherently weak, but the top then cannot be easily released in order to empty the receptacle.

Quite frequently these receptacles will have a plastic bag-type liner in them which actually receives the recyclables or the refuse. They also may be provided with a solid plastic container inside the slatted receptacle in order to receive the recyclables or the refuse. In both cases, however, it is impossible to easily empty the contents by removing either the flexible bag-type plastic container or a solid cylindrical receptacle, unless the top is completely removed or else swung largely out of the way on a hinged arrangement or the like.

The construction of the top of the receptacles with differentially elevated slats at different points around the circumference for aesthetic considerations does not easily lend itself to the provision of either a strong top or a conveniently openable top. If a top is merely laid in upon some sort of supports within the interior of the slatted receptacle, it may be easily removed for emptying the receptacle, but may be just as easily removed by vandals or scavengers.

There has been a need therefore for a strong, durable and conveniently openable and securable lid or top for slanted type slatted receptacles used in upscale public locations as well as for a stronger structural arrangement for the upper portion of a slanted top-slatted receptacle. There has been a need, furthermore, for such stronger construction to not interfere with and, if possible, to improve the aesthetics of such slanted top-slatted receptacles.

OBJECTS OF THE INVENTION

It is the object of the present invention therefore to provide a strong durable top upon a slanted top-slatted receptacle for recyclables or refuse.

It is a still further object of the invention to provide a top arrangement which may be locked to prevent scavenging and the like and unlocked by authorized persons to empty the receptacle.

It is a still further object of the invention to provide a top combination which not only effectively closes off the receptacle in a pilfer-proof manner, but also substantially strengthens the top of the receptacle to prevent breakage or other damage due to vandalism or other causes.

It is a still further object of the invention to provide a strong durable top which is substantially damage resistant.

It is a still further object of the invention to provide an economical yet strong durable top which is both attractive and effective in maintaining security of the receptacle.

It is a still further object of the invention to provide a removable lid or cover for a slanted top-slatted recycling and refuse receptacle which can be easily removed for emptying the receptacle and easily replaced for use of the receptacle.

It is a still further object of the invention to provide a removable lid or top for a slanted top-slatted receptacle which is easy to make and economical in manufacture.

It is a still further object of the invention to provide a top section for a slanted top-slatted recycling or refuse receptacle which is so strengthened as to be substantially indestructible by the usual vandal.

It is still further an object of the invention to provide a strengthening arrangement for the top of a slanted top-slatted receptacle which is easy to mount upon the receptacle and, once mounted, almost impossible to remove by unauthorized persons.

It is a still further object of the invention to provide a strengthening ring having a particular configuration which conforms to the inside of a slanted top-slatted receptacle when such ring is positioned within the receptacle at a substantially uniform distance from the top around the circumference of the receptacle.

It is a still further object of the present invention to provide a structural ring with an integral seat for the top of a slanted top-slatted receptacle which is configured in such a manner that the slats of the receptacle lie flat against the outer surface of such ring when it is secured within the receptacle and which receives a lid securely against the seat on the receptacle ring.

It is a still further object of the invention to provide a cast aluminum seat and lid for a slanted top-slatted receptacle which lid can be securely locked to the strengthening ring of the receptacle.

It is a still further object of the invention to provide a secure top for a slanted top-slatted receptacle which cannot easily be broken into by scavengers and the like to remove the contents of the receptacle.

It is a still further object of the invention to provide a receptacle for recyclables and refuse which is considerably sturdier at the top than previously available receptacles.

It is a still further object of the invention to generally improve the strength of a slatted-type slanted top receptacle.

It is a still further object of this invention to provide a slanted top-slatted receptacle having a strengthened, more pleasing external configuration.

It is a still further object of this invention to provide an arrangement whereby the structure of a slanted top-slatted-type receptacle is substantially stiffened internally near the top.

It is a still further object of the invention to provide a securely closed slatted-top slanted top receptacle which is both economical and attractive.

Other objects and advantages of the invention will become evident from a study of the following description and appended drawings.

BRIEF DESCRIPTION OF THE INVENTION

This invention is directed to the provision of a lid or top arrangement or assembly for a refuse and recycling receptacle comprised of a series of slats arranged adjacent to each other in a circle to form a cylindrical container and having differential lengths arranged so that the top of the container is slanted. The top assembly for such receptacle includes an outer structural ring formed in a somewhat oval, elliptical or ovoid shape and having an outer angled curvature which matches with the inside configuration of the container. The outside of the structural ring is slanted outwardly from the top to the bottom on one side, slanted inwardly from the top to the bottom on the opposite side and configured to be substantially vertical at positions approximately ninety degrees from the slanted out and slanted in positions, the intermediate portions of the outer sides of the ring incorporating or having progressive changes in the slant of the outer surface of such ring to conform to the inner configuration of a receptacle. The structural ring has preferably a "T" section with the outer end or top or cross portion of the "T" forming the outer continuously changing differential slanted portion of the structural ring and the web of the "T" forming an inwardly extending seat for the bottom of the lid or top which may be locked to the seat by outwardly extending tabs. The outer lower portion of the "T" has a series of holes around the perimeter for the receipt of fastenings which serve to hold the slats of the receptacle flat against the outside of the "T". The top or lid of the top assembly is preferably made as an upwardly curved outer section having a flat section around the outer rim which lies flat against the web of the "T" forming the outer ring. Alternatively, the lid itself can be flat. The outer ring is slightly elliptical or oval in order to better conform with the shape of the inner portion of the receptacle when the ring is angled into position. The lid or top is also preferably slightly elliptical, oval or ovoid in order to conform with the oval or ovoid shape of the structural ring. However, a less preferred form of the top could be substantially round with the web of the "T" of the outer structural ring extended to make up the difference where the ring would have greater dimensions in one direction than in the perpendicular direction.

Preferably, the outer cross T section of the outer upper ring has a generally decreasing cross section from top to bottom and there is a lower or bottom ring which has a generally decreasing cross section from bottom to top resulting in a slightly slanted outer surface which, when plastic slats are brought closely against the outer edges of the two structural rings, leads to a pleasing bowed or slightly hourglass-shaped outer configuration of the receptacle.

The orifice in the lid is preferably provided toward one side of the lid and surrounded by a depression in the top of the lid. The lock is then preferably placed at the top of the lid. However, the exact arrangement of the opening, depression and lock on the surface of the lid together with the curvature of the lid are primarily ornamental design features which may be changed without effecting the function or utility. For example, the top may be flat, the opening in the lid may be provided in the center and the lock may be provided on the same side as the orifice in the lid. In addition, the opening can be made much larger or can be divided into two separate openings.

DESCRIPTION OF THE PREFERRED EMBODIMENTS

The present invention provides a novel structure for a lid assembly for use on a slanted top slatted recycling and refuse receptacle to provide security against scavenging as well as considerably strengthening the top section of the slatted receptacle. The combination of the new top and structural ring supporting the top upon a slatted top receptacle provides a substantially stronger, more vandal-resistant construction in an economical and convenient manner. Previous arrangements for applying a top to slanted top-slatted-type recycling and refuse receptacles left much to be desired in that the top of the receptacle was an inherent weak point and unauthorized persons could easily gain access to the interior of the receptacle with a potential loss of valuable recyclables as well as the potential for dumping of refuse as well as recyclables into the immediately surrounding environment. It is a common problem in this day and age with publicly exposed equipment such as park benches, tables, light standards and particularly refuse containers and the like to have significant vandalism committed against such equipment.

A new design for slatted receptacles, which had previously been flat topped because of certain design and aesthetic considerations, has within the last few years provided a slanted top upon such receptacles which has proven to be considerably more attractive from an ornamental viewpoint than previous slatted designs, particularly when used in multiple units surrounding a central unifying post or shaft. However, the slanted top design has had some problems of its own peculiar to its arrangement and structure, particularly with respect to the fact such design may be the more susceptible to vandalism due to the differential lengths of the outer slats which expose some of such slats to more chance of damage due to excessive stress being applied to them than to other slats. Also the slanted top design has not been well adapted to the provision of a secure top upon the receptacle to discourage scavenging within the receptacles. Prior used tops have been essentially merely laid on the top of inwardly extending tabs or the like protruding from or attached to the inner surfaces of the slats and there has been no effective way to reinforce such tops to guard against damage or to provide a top arrangement with a secure vandal or scavenger resistant construction. The present invention by providing an especially shaped and constructed structural ring combined with a sturdy removable top in the upper end of the slanted top of the receptacle has now solved these problems.

Figure 1:
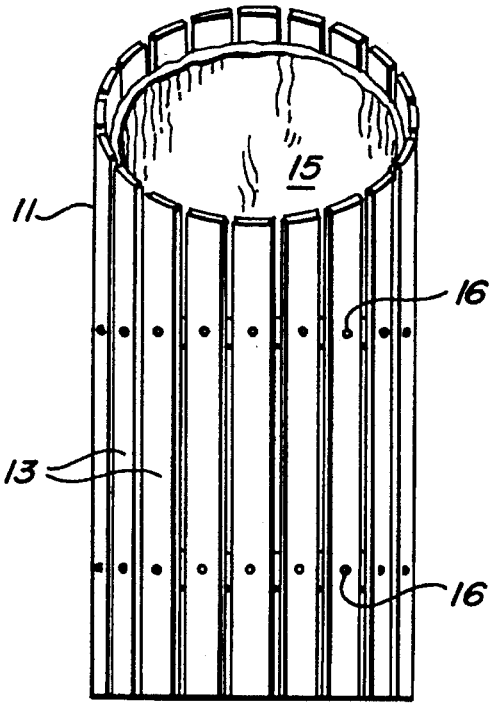
FIG. 1 PRIOR ART
FIG. 1 is a side elevation of a slatted-type slanted top receptacle as constructed prior to the present invention.

Referring more particularly to the appended figures, FIG. 1 shows a prior art slanted top slatted receptacle 11 comprised, on its outer circumference at least, of a series of adjacent slats 13 formed from a plastic composition having the general appearance of wood in some cases or other neutral colors in other cases. Preferably such plastic resin slats are made from recycled plastic resin material. In FIG. 1 there is shown within the interior of the receptacle 11 a plastic resin bag-type container which actually receives the recyclables or refuse deposited within the slatted-type-slanted top receptacle. It will be understood that as an alternative, a solid interior receptacle could also be used to actually collect the materials deposited within the receptacle 11.

Figure 2:
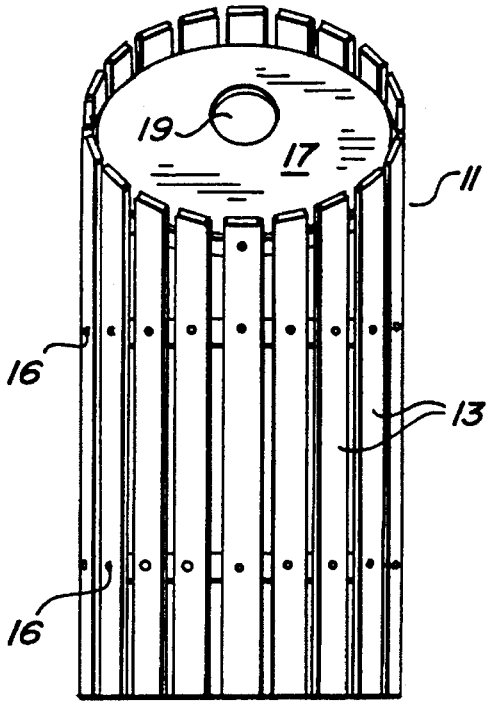
FIG. 2 PRIOR ART
FIG. 2 is a further view of the slatted-type slanted top receptacles of the prior art with a widely used lid or covering provided in the top of the receptacle.

FIG. 2 shows the same slatted-type slanted top receptacle of the prior art as shown in FIG. 1, but having in this case, a solid top or lid resting within the upper portion of the receptacle 11. The lid 17 has a central orifice 19 through which recyclables and refuse can be inserted by the public. The top merely rests upon tabs or the like, not shown, extending from the interior surface of three or four of the slats.

Figure 3:
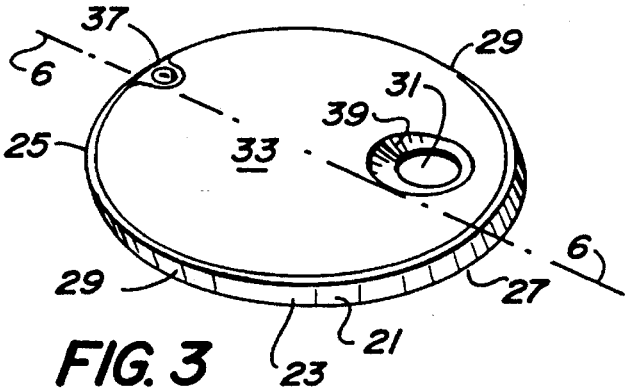
FIG. 3 is an isometric view of the combined top and structural ring of the present invention.

FIG. 3 is an isometric view of the outside configuration of the structural ring and lid assembly of one embodiment of the invention in which an outer structural ring 21 has an outer surface 23 which continuously changes from one portion of the outer surface to another and having an inward slant from top to bottom at the upper portion 25 and an outward slant from top to bottom at a lower portion 27 of the ring. The two central portions 29 of the outer structural ring 21 have essentially a vertical configuration or no slant. The designations "upper" and "lower" and "central" portions in this connection refer to the inclination of the structural ring and lid combination when positioned in the top of a slanted top-slatted receptacle. The noted differentially varying slant or angle of the outer surface 23 of the outer structural ring 21 is angled such that when the structural ring and lid are inserted within the top of the slatted receptacle at approximately the same angle as the angle of slant of the top, the outer surfaces of the ring will all be exactly vertical or, alternatively, the same as the angle of the slats referred to true vertical and the slats will lie flat against said outer surfaces 23. In the usual construction, the sides of the ring will be oriented in a vertical direction when the structural ring 21 is placed within the slatted receptacle having vertically configured slats.

An orifice 31 is provided in the lower portion of the top or lid 33 and the bottom outer edges of the lid 33 are engaged with a top surface or seat 45 on an inner flange 43 parallel with the upper surface of the structural ring 21. See, in particular, FIG. 4. A locking mechanism 37 is provided, preferably near the upper portion of the lid. A depression 39 in the top 33 may surround the orifice 31 in the top 33.

Figure 4:
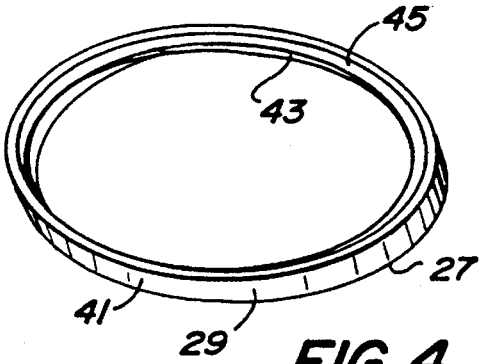
FIG. 4 is an isometric view of the structural ring of the present invention by itself.
Figure 5:
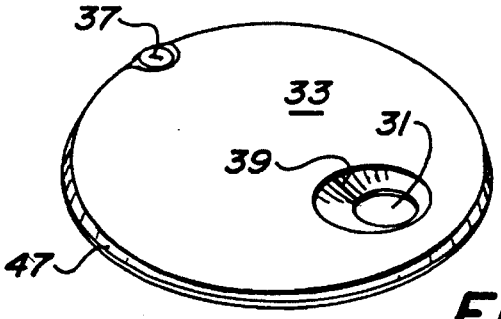
FIG. 5 is an isometric view of the lid of the present invention by itself.
Figure 6:
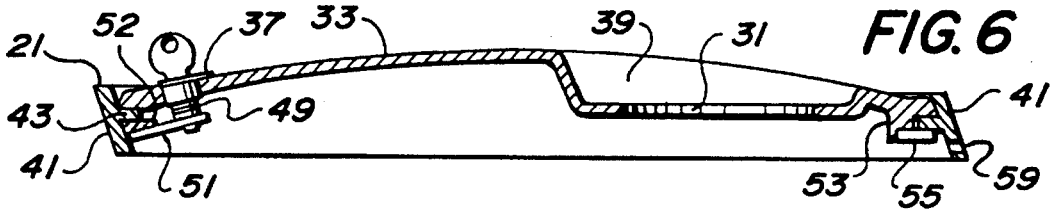
FIG. 6 is a cross section of the combined lid and structural ring as shown in FIG. 3 showing how the lid fits into the ring.

As seen in FIG. 4 and also in FIG. 6, which is a cross section along line 6 in FIG. 3, the outer structural ring 21 has preferably a basic T-section with the "T" understood to be lying on its side with the outside of the crosspiece 41 forming the outer surface of the structural ring 21 and having, as explained above, a continuously changing angle upon its outer surface matching the angle of the adjacent more or less vertically arranged plastic slats of the receptacle 11. The central web 43, or leg of the "T", in the meantime extends inwardly and is tilted overall at the same angle as the structural ring itself which, as indicated above, is angled at approximately the same angle as the top of the slanted topped receptacle. The upper portion or surface 45, as best shown in cross section in FIG. 6, serves as a seat for the outer sides 47 of the lid 33. As seen best in FIG. 6, the locking means 37 has a pedestal or lock extension 49 extending from the lock 37 downwardly and at the lower end, has a metal crosspiece 51 which, when the pedestal or an internal portion of the pedestal is turned by the locking device 37 may pivot to contact the underside of an extension or raised portion 52 of the leg or web of the "T" 43, effectively locking that sine of the top or lid 33 to the outer structural ring 21, or more particularly to the extension 52 of the leg or web 43 of the outer structural ring 21. Likewise, at the opposite side of the top 33, there extends from the inside of the top, a second pedestal 53 having a cross piece 55 permanently secured to it, the end of which also engages the bottom of the leg or web 43 of the T-section of the outer structural ring 21 and therefore secures that side of the lid 33 to the structural ring. As indicated above, it will be recognized that the relative locations of the locking device, i.e. the rotatable pedestal or portion of the pedestal 49 and the stationary pedestal 53 can be reversed so that the lock is on the lower portion of the lid or even on the side of the lid. The location of the lock is primarily a matter of balance and design so that the outside of the lid has a pleasing ornamental appearance to the onlooker. It will be understood, of course, that the pedestal 49 and the pedestal 53 must always be approximately opposite each other in order to effect satisfactory locking of the lid or top to the structural ring 21. It will also be understood that while it is preferred to use the stationary pedestal 53 and cross piece 55 secured thereto, these structures could be replaced by a sturdy hinge movably connecting the lid with that side of the structural ring 21.

Figure 7:
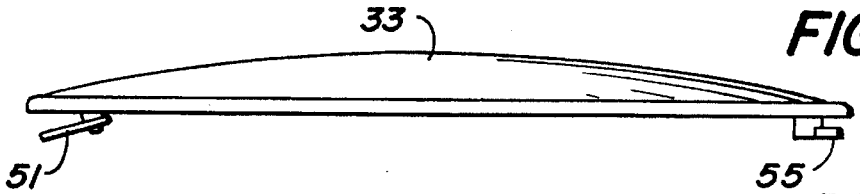
FIG. 7 is a side view of the preferred lid shown in FIG. 5.

FIG. 7 is a side view or elevational view of the top 33 showing the general convex curvature of the top which again is primarily a design feature from an artistic viewpoint as well as the crosspieces 51 and 55 of the locking means.

Figure 8:
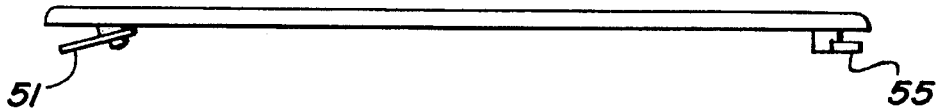
FIG. 8 is a side view of an alternative and less preferred form of the lid having a flat top.

FIG. 8 shows an alternative lid which has a substantially flat top. The lid is preferably a casting and there is little difference between the two lids in FIGS. 7 and 8 other than design features to provide a more pleasing combination with the receptacle.

Figure 9:
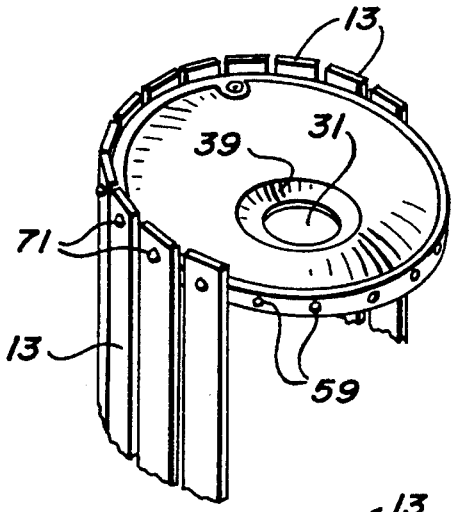
FIG. 9 is a partially broken away isometric view of the structural ring and lid of the invention mounted within the top of a slanted top-slatted receptacle showing the fastening orifices on the side of the structural ring for securing the slatted sides against the structural ring.

FIG. 9 is a partially cutaway isometric view of the combined structural ring 21 and lid 33 secured in the top of one of the slatted-type-slanted top receptacles. As shown in FIG. 9, the outer circumference of the lower portion of the crosspiece or head of the "T" 41 is provided with fastening orifices. In other words, the outer section of the structural ring 21 is provided with a series of orifices 59 which provide threaded fastening orifices for fastening the structural ring 21 to each one of the slats 13, which are likewise provided with an orifice to match the orifices in the ring 21. It should be noted that the orifices 59 are provided in the lower portion of the outer section 41 of the structural ring 21 below the flange 43 so that the fastenings do not interfere with the placement of the lid 33 upon the upper surface 45 or seat upon the inwardly protruding flange 43. As will be seen, when each one of the slats is attached to the structural ring 21, which is fairly close to the top of the slats and also positioned preferably an approximately equal distance from the top of each of the slats, a very rigid overall structural assembly is provided at the top. The lower portion of the structure of the slatted assembly is provided, preferably with at least one and in some cases two further rings which can take the form of fairly conventional flat barrel-type rings within the interior of the receptacle to which each of the slats is also attached by a screw fastening. Preferably, however, the lower ring 63 will take the form of an L-section with a lower flange on the bottom to increase the strength and, if desired, to provide a circumferential flange upon which a circular bottom section may be rested. Usually, any such bottom section will be merely loosely laid upon the lower leg of the L-section flange, since it need not provide any structural strength to the entire assembly. However, if it is desired to have a tight-fitting bottoms it will be preferable to use a T-section structural ring, as in the top of the receptacle, rather than an L-section. The L-section ring shown could also be reversed so that the flange is on the top.

Figure 10:
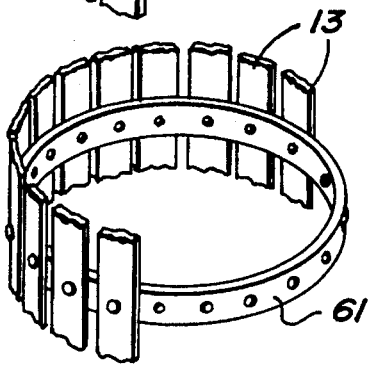
FIG. 10 is a partially broken away central sectional view of the same slatted receptacle as in FIG. 9 showing a structural ring within the interior of the slatted receptacle near the center of such receptacle to which structural ring the slats are connected.

As will be noted, when each of the slats is attached through screw fastening to each of the rings 21, 61 and 63, a very strong and essentially almost rigid structural section is provided. Such structural section is particularly strong at the top and the bottom where the structural rings 21 and 63 are located, since such rings and particularly ring 21 at the top have extra stiffness, provided by the interior flange 43 which serves as a seat for the lid 33. In fact, when one of the receptacles is to be used in a fairly protected environment where it is unlikely to be subjected to any untoward vandalism or exposed to any other potentially damaging impacts or shocks, the top lid or structural ring section may be secured to the slats of the slatted slanted top receptacle at only certain locations such as at the bottom, the top and both sides. However, as will be understood, since it is usually advantageous to have as strong a structure as possible, it is preferred to attach each of the slats 13 to the structural ring 21 by a suitable, threaded-type fastening or for that matter, any other suitable fastening. If this is done, it will in most cases not even be necessary to use the central reinforcing ring 61 shown in FIG. 10, except where an unusually rigid structure is desired.

Figure 12:
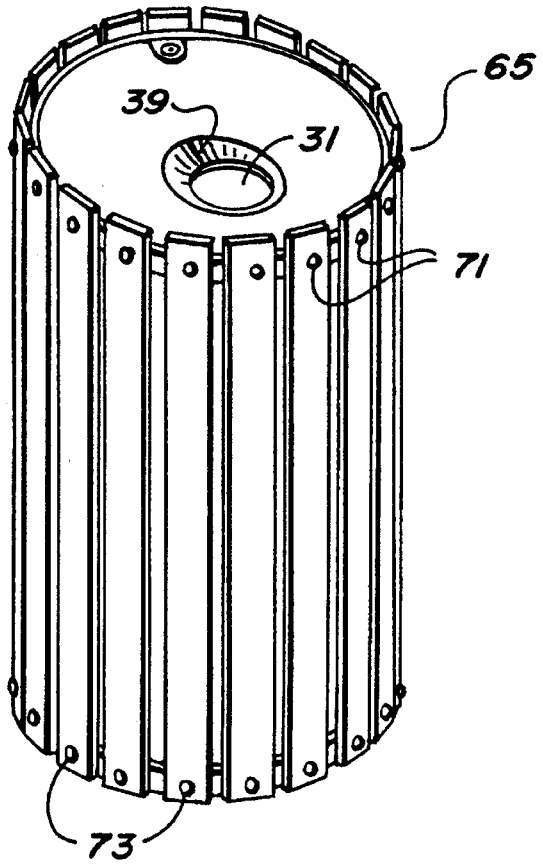
FIG. 12 is an isometric view of the overall combination of a slatted exterior-slanted top receptacle with the combined structural ring and lid or top of one embodiment of the invention.

FIG. 12 is a perspective view of the outside of the complete receptacle assembly in accordance with the invention, of a slatted slanted topped receptacle with the lid and structural ring combination of the invention attached thereto to form a receptacle 65 in accordance with the invention, which is both attractive and strong and durable as well as resistant to scavengers and vandalism.

Figure 13:
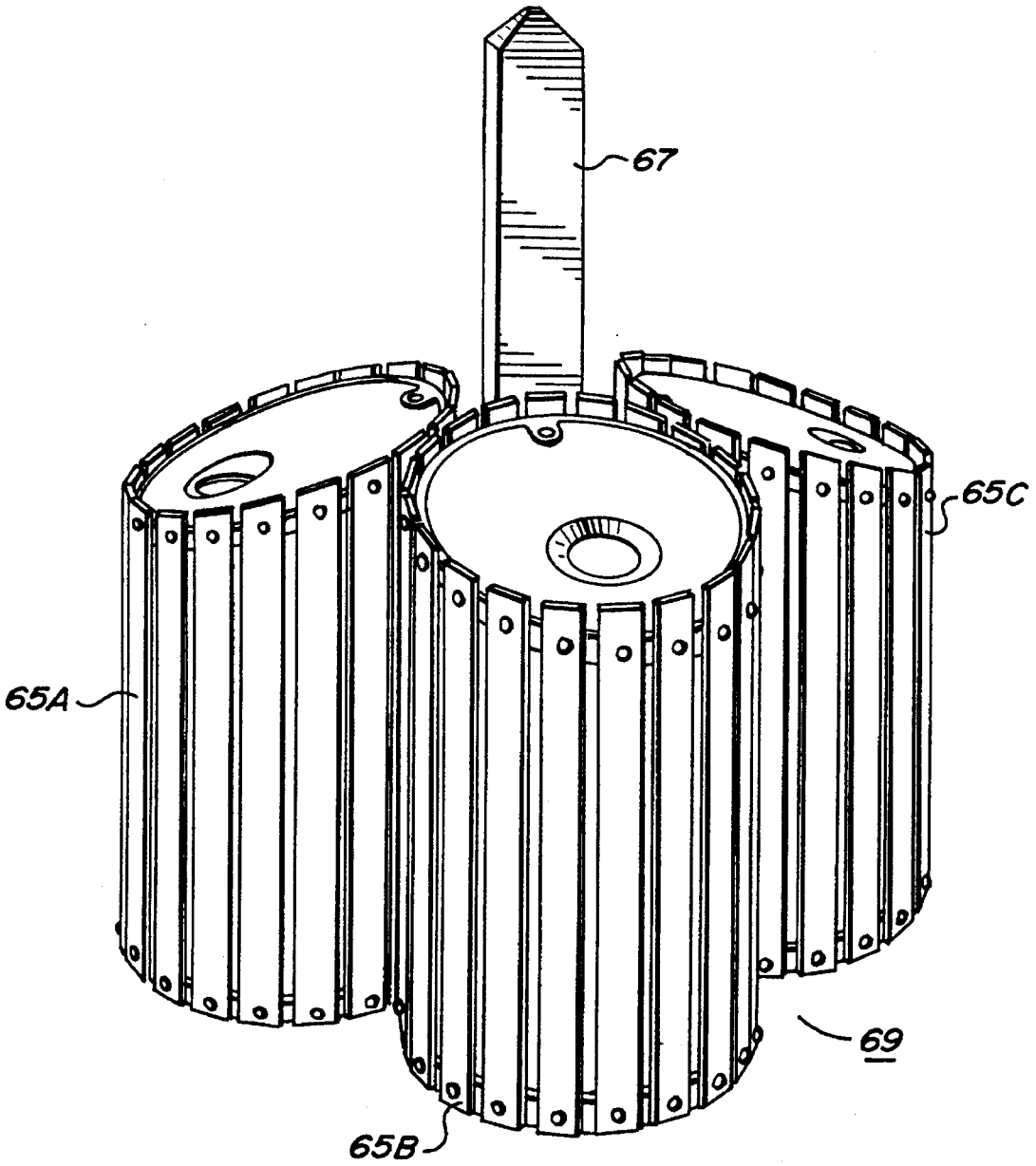
FIG. 13 shows a typical assemblage of several of the slanted top- slatted side receptacles as shown in FIG. 12 arranged around an aesthetically unifying post for use as a group of receptacles.

FIG. 13 shows several of the receptacles of the invention 65 designated as 65A, 65B and 65C surrounding and preferably attached to a central unifying post 67 to provide a multiple receptacle arrangement for the disposal of either different recyclables in each receptacle or to provide extra capacity for recyclables and refuse. The combined group of receptacles shown in FIG. 13 has been arbitrarily assigned a separate number 69.

Figure 14:
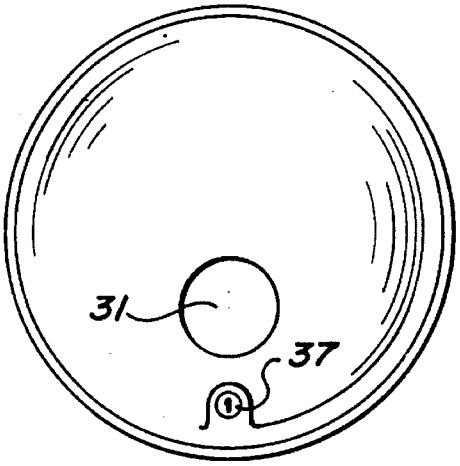
FIG. 14 is a plan view of an alternative embodiment of the invention in which the lock means and the orifice are located on the same side or bottom section of the lid.

FIG. 14 is a plan view of an alternative design for the top 33 in which the orifice 31 does not have a depression 39 around it as shown in the previous drawings or figures and also has the locking means 37 directly under the orifice 31 rather than at the top of the lid 33. Both the orifice and lock are therefore in the same quadrant of the lid rather than opposite quadrants.

Figure 15:
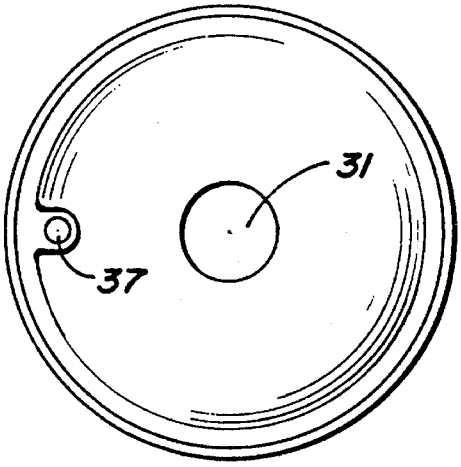
FIG. 15 is a plan view of a still further alternative embodiment of the invention showing the top of the lid wherein the orifice is provided in the center of the lid rather than in the lower portion and the lock is in the side.

FIG. 15 shows a still further embodiment of the invention in which the lid 33 has the orifice 31 directly in the center with the lock 37 at one side. There is also no depression around the orifice 31 in FIG. 15. It will be understood that in either FIGS. 14 or 15, the lid may have either an upward hemispherical section such as shown in FIG. 7 or a basically flat lid arrangement as in FIG. 8. The lock 37 could also be at the side of the construction shown in FIG. 14, although this would not be too desirable from an aesthetic or design viewpoint.

Figure 16:
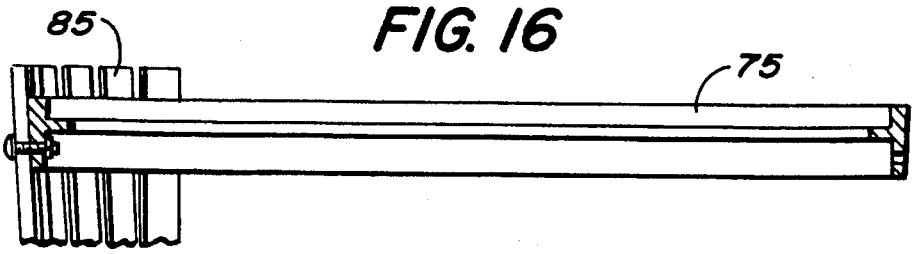
FIG. 16 is a partially broken away sectional view of a preferred structural ring of the invention in which the ring has a draft or decreasing side or cross section toward the bottom.

FIG. 16 is a partially broken away section taken through the top structural ring 75 of a preferred version of the invention showing a slight draft 77 or decreasing section in the ring in this case toward the bottom and from the outside of the ring 75. Such a draft or decreasing section is frequently used to aid in releasing cast metal objects to allow easier separation from the mold without shattering the mold. The present inventors have discovered that if such a draft is provided upon the surface of the ring 75 and arranged correctly with a similar draft on the lower ring 77 of the receptacle, that a very pleasing and aesthetic configuration can be provided to the surface of the receptacle.

Figure 11:
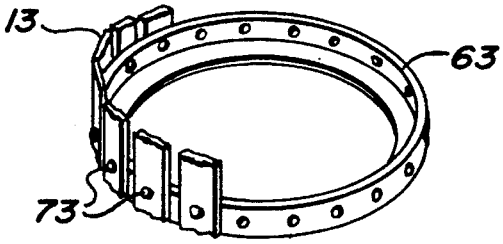
FIG. 11 is a partially broken away isometric view showing the bottom of the slatted receptacle shown in FIGS. 9 and 10 with a structural ring having the slats attached thereto.
Figure 17:
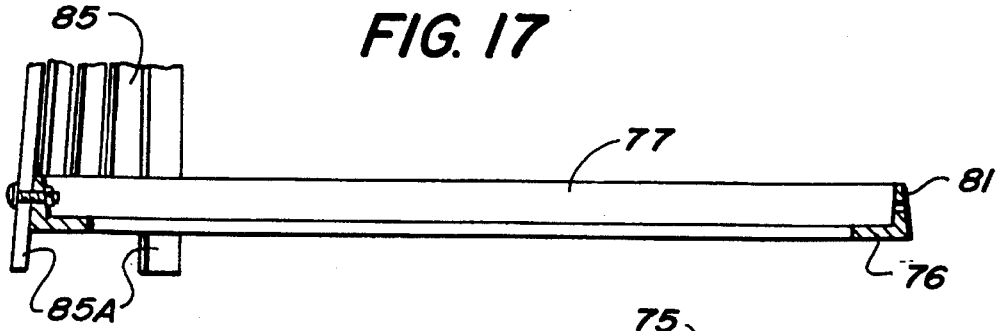
FIG. 17 is a partially broken away sectional view of the bottom rings of the invention showing a draft or decreasing side or cross section toward the top.

FIG. 17 is a similar view of the bottom ring 79 where it can be seen that such lower ring has an upwardly tapering draft 81 which also allows the bottom ring to be more easily cast from an aluminum alloy and removed from the mold. When used for the recycling and refuse receptacle of the invention, this arrangement with slight tapers or tapered sections 77 and 81 in the outside of the rings 75 and 79 when formed in opposite directions as shown in FIGS. 16 and 17 and when the outer slats on the slanted top-slatted receptacle are drawn in fairly tightly against the outer surfaces of the two rings, preferably by screw fastening means, the slats take a slightly inwardly bowed configuration, which, though slight, has a large effect upon the overall appearance. The slight bowing or hourglass appearance registers on the eye as a very pleasing lightness in the design giving a slightly airy or less bulky appearance. The slanted arrangement of the top structural ring with respect to the plastic slats, furthermore, prevents the spring tension in the slats from warping or springing the entire receptacle. As indicated in connection with FIG. 11, the bottom ring 77 shown in FIG. 17 could also be reversed to bring the flange to the top, in which event the taper or draft, particularly on the outside, would also be reversed so that it remains inclined inwardly toward the top.

It will be understood that the draft, or slight inward inclination, of the outside of the top structural ring 75 will preferably be provided on all sides of the rings. Thus in FIG. 17, the slight inward slant of the side walls of the lower ring 77 will be understood to be the same on all sides, or preferably the same, since it need not be. It will likewise be understood that the top structural ring 75 will preferably have a similar slight inclination or draft at least on the outside in a downward direction on all sides. FIG. 16 shows such inclination only on the substantially vertical intermediate sides of the structural ring 75 where it is most visible or evident between the generally outwardly inclination lower outside front of the ring and the generally inwardly inclined upward top of the ring. However, it will be understood that the additional slight inward slant or draft of the external surface of the upper structural ring also preferably occurs on these surfaces. On the other hand, the pleasing hourglass shape of the slatted receptacle is perhaps most visible on the sides and to some extent, on the front of the receptacle in use so that the draft or slight inward inclination of the slats making up the outside walls of the receptacle is most important on the sides also from an overall aesthetics viewpoint.

As indicated above, previous slatted receptacles, including the slanted top-slatted receptacles of the present invention, were previously made by the present inventor using a central steel metal barrel as a central support for the outside slatted structure. However, when forming a slatted-type structure with internal structural rings, it is possible for one ring to rotate somewhat with respect to another ring or rings ultimately placing the slats in a slanted configuration which, while not really, per se, harmful, except for the excess stress placed upon the fastenings, does make the entire structure appear shoddy and defective. It has been found, however, that when using the shaped upper ring of the invention and placing it at an angle as shown to accommodate different heights in the outer slats to provide a slanted top configuration on the slatted receptacle, the slanted structural ring not only holds all of the slats firmly at the top, but also prevents the entire structure from twisting. It is effectively impossible for twisting to occur so long as the inclination of the structural ring is reasonably steep, since any twisting would result in either shortening or lengthening the point at which any given slat is secured to the structural ring 29 (in FIG. 12) or 75 (in FIG. 18) which shortening or lengthening is prevented by the resistance of adjoining slats to stretching or compression.

Figure 18:
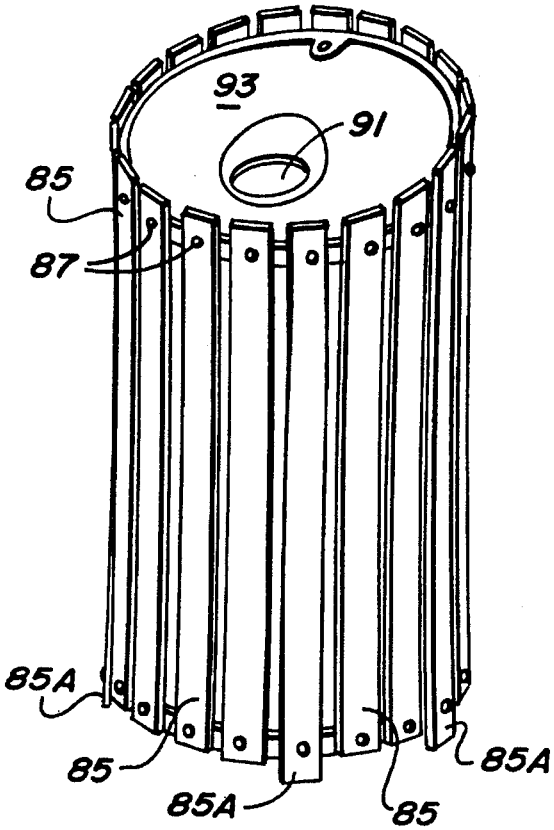
FIG. 18 is an isometric view of the overall combination of a slatted exterior-slanted top receptacle using the preferred structural rings of FIGS. 16 and 17 showing a slight bow or hourglass shape to the slatted sides of the receptacle plus short legs formed from lengthening some of the slats.

FIG. 18 is an isometric view of the preferred embodiment of a slanted top-slatted receptacle 83 of the invention showing a slightly hourglass shape of the outer slats 85 of the receptacle 83 as a result of being pulled tight against the structural rings of the invention having oppositely directed decreasing sections on the exterior of such structural rings which biases the upper and lower portions of the slats inwardly to provide a slight inward bowing of the slat structure. As indicated, the inclined disposition of the upper structural ring also braces the entire structure, particularly against any twisting and thus provides additional rigidity to the entire structure. Each of the structural rings is connected to the slanted structural ring by screw fastenings 87 extending through the slats 85 and the lower flange of the structural ring as shown in the previous figures. In FIG. 18 it will also be seen that every third or fourth plastic slat 85A is somewhat longer on the bottom. These slightly longer slats raise the receptacle structure from the ground or support surface and result in a slight appearance of the receptacle floating above such surface. This provides also a lighter more airy appearance, which increases the aesthetics of the receptacles, although it has no substantial effect on the strength or rigidity of the receptacle. In fact, the receptacle shown in FIG. 12 has additional support with the surface upon which it rests. However, such additional support is ordinarily not required. If desired, of course, additional support means, or legs, not shown, can be attached to the lower structural ring 77 preferably from the bottom of lower flange 76 of the lower structural ring 77.

Figure 19:
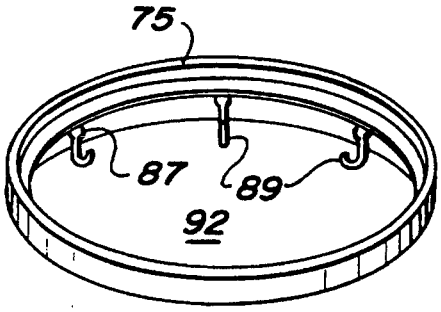
FIG. 19 is an isometric view looking into the top of the receptacle of the invention showing hooks mounted from the structural ring for supporting an internal bag.

FIG. 19 shows an isometric view of the inside of the top of the preferred receptacle showing a series of hooks 89 attached to the interior ends of the screw fastenings 87 which secure the slats 85 to the lower flange 79 of the structural ring 75. These hooks 89 support the top of a heavy industrial grade plastic bag 92 which receives the material deposited into the receptacle through the opening 91 in the top or lid 93. When the bag is filled or partially filled, it may be easily removed from the receptacle after opening the top 93 and a new bag inserted. The hooks 89 could also be attached to the slats or other structure, but attachment to the lower flange of the upper structural ring is particularly effective.

Figure 20:
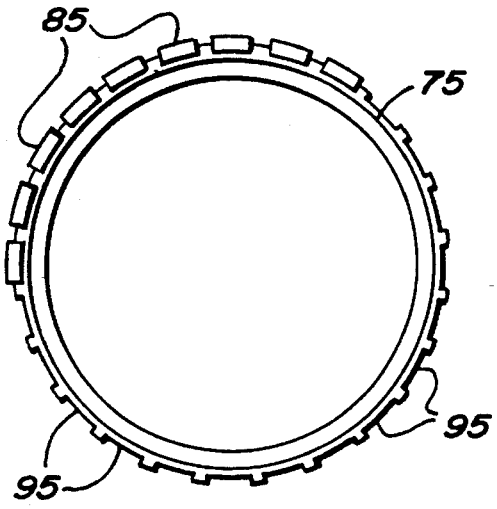
FIG. 20 is a view of the ring of the invention showing rectangular grooves in the face of the ring to receive and reinforce the slats.

FIG. 20 shows a further embodiment of the structural ring 75 of the invention having a series of rectangular recesses 95 in the surface into which the ends of the slats 85 may be received. The rectangular recesses or slots 95 further hold the slats 85 in vertical alignment with each other and form a particularly rigid structural arrangement. The same design arrangement may be used on the bottom structural ring 77. While the slotted arrangement is a preferred arrangement for rigidity and strength, it requires the fit between the outside dimensions of the slats and the inside dimensions of the slots to be fairly precise in order to add to the strength and rigidity, somewhat decreasing the ease of manufacture. Furthermore, as pointed out above, the slanted or inclined disposition of the top structural ring 75 in itself forms a very rigid, stable structure which in most instances is quite satisfactory without further reinforcement.

Figure 21:
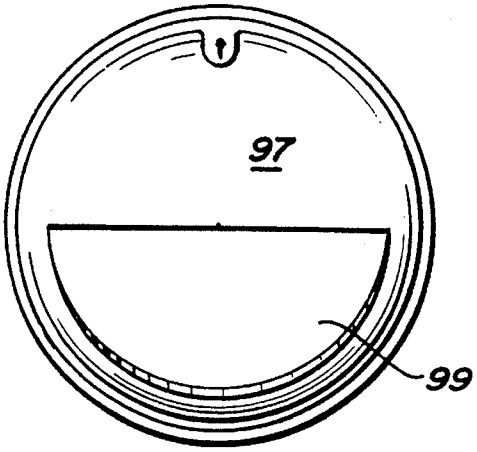
FIG. 21 is a plan view of the lid of the invention with a large semicircular orifice in the top.

FIG. 21 is a plan view of an alternative embodiment of a top 97 of the invention having one large semicircular opening 99 which has been found to be convenient in some circumstances.

Figure 22:
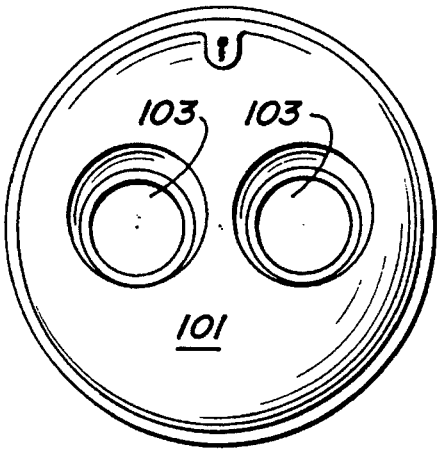
FIG. 22 is a plan view of the top of the invention showing two side-by-side orifices in the top.

FIG. 22 is a plan view of a still further alternative of a top 101 of the invention showing a pair of dual openings or orifices 103 in the top. If desired, these may lead into separate containers or bags disposed under the openings 103.

Figure 23:
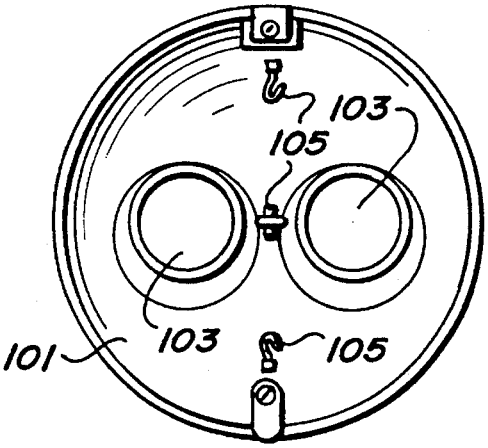
FIG. 23 is a bottom view of the top or lid shown in FIG. 22 showing a row of hooks in the top to which plastic bag-type internal receptacles may be attached.

FIG. 23 shows the underside of the top or lid 101 showing the disposition of a row of hooks 105 in the center. Such row of hooks 105 or other securing means may be used when two plastic bags or the like are used under the dual orifices to receive materials disposed of into the two dual orifices 103. Each hook may be supported from a screw fastening means threaded into an opening in the bottom of the lid, preferably in restricted size pedestals projecting from the bottom. It will be understood that the remainder of the two plastic bag-type containers may be supported by similar hooks attached to the lower surface of the structural ring 75 as shown in FIG. 19. If desired, two rows of the hooks 105 may be used in the center of the lid, one for each bag. Of course, other types of dual containers such as solid plastic containers or the like may be used under the dual openings 103 as well.

Figure 24:
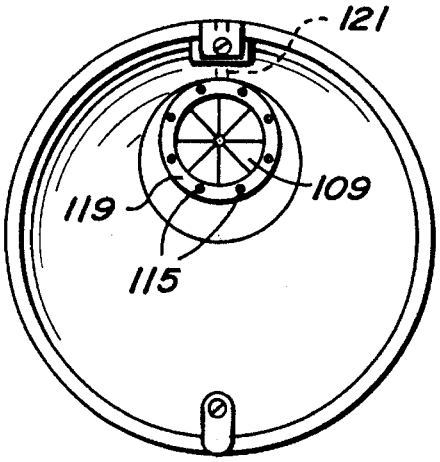
FIG. 24 is a bottom view of an embodiment of the invention showing a rain shield applied to the orifice.

FIG. 24 shows the underside of a top generally as shown in FIG. 23 with, however, a single orifice as shown in several of the previous figures with a further rain shield attached to the bottom of the orifice in the lid. The rain shield 109 is comprised of a flexible polymeric composition such as rubber or neoprene cut into a series of contiguous triangular closure sections 111 which are left attached to a surrounding ring 113 of the same material, which ring or outer section may be attached to the lip of the orifice 91. Preferably the ring is attached by screw fastenings 115 to the underside of the lip of the orifice as seen in FIG. 24. The screw fastenings may pass through small orifices 116 adjacent the base of the flexible triangular closures 111.

Figure 25:
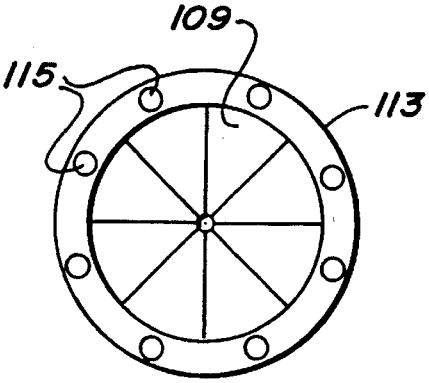
FIG. 25 is a plan view of the rain shield shown in FIG. 24 by itself.

FIG. 25 shows the rain shield 109 by itself and shows fastening openings in the outer lip.

Figure 26:
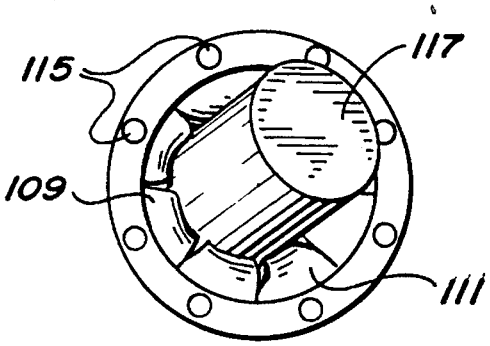
FIG. 26 is a plan view of the rain shield of FIG. 24 and 25 with a can just being inserted through such rain shield.

FIG. 26 shows the rain fastening with an empty soft drink can or the like 117 being inserted through the flexible triangular sections 111. Since an aesthetically desirable orifice through the lid includes a depression 119 around the orifice, it may be desirable to provide a short drain 121 shown in FIG. 24 in dotted lines from the side of the bottom of the depression to a position adjacent the outer edge of the receptacle to drain moisture collected upon the surface of the rain shield and draining to the side of the receptacle where it can be discharged from the side through the slats or otherwise outside the internal refuse recycling bags or other collectors. The drain may be in the form of a tubular conduit passing to or through the structural ring or may be free of the ring.

From the above description and explanation in combination with the various figures, it will be understood that the present invention provides a great improvement in both the strength of a slatted-type slanted top receptacle and greater security against both scavenging and vandalism directed either at the contents of the receptacle or the receptacle itself. The locking means provides a convenient arrangement whereby authorized personnel may be granted access to the interior of the receptacle for emptying or for other purposes, whereas unauthorized persons will find it difficult to gain access. It will be understood that if desired, a stronger locking means could be provided. However, in most cases, the locking arrangement, including the flat metal pieces, will be adequate enough protection. In the case of a particularly determined vandal or scavenger, the metal pieces 51 and/or 55, which are merely screwed to their pedestals, may be bent, allowing such scavenger or vandal to remove the lid from the structural ring or the seat 35 in the structural ring 21. However, it is usually better to allow such removal of the top by a particularly determined or a powerful individual, whereupon the flat metal pieces may be easily replaced by unscrewing the bent pieces and replacing with new, flat pieces, rather than suffering possible structural damage to the actual receptacle. While no structural damage is likely to result to the lid itself, since it is a fairly heavy cast aluminum lid or to the structural rim, which is also fairly heavy, almost any locking arrangement can be forced with sufficient determination. Consequently, it is often better to accept ultimate forcing of the locking arrangement which can be easily repaired, rather than providing an ultimate locking arrangement which may allow so much force to be applied to the top of the receptacle that the fastenings securing the support ring 21 to the individual plastic slats 13 may be pulled away.

In the preferred arrangements of the invention with the outer slats bowed due to being tightly secured to the slightly inwardly inclined outer circumferences of the structural ring 75 and the provision of hooks within the receptacle secured to the lower portion or flange of the upper structural ring, as well as the provision of a rain shield in or contiguous with the upper orifice in the lid, a more pleasing appearance and additional convenience and efficiency of the receptacle is provided.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

We claim:

1. A removable lid combination for a recycling and refuse receptacle comprised of a series of substantially vertical slats of varying lengths secured together to form a substantially round receptacle with a slanted top, said lid combination comprising:

(a) a rigid structural ring having top, side and bottom surfaces and having an ovoid overall configuration and a smoothly curved differentially angled outside surface adapted for interengagement with the inside surfaces of the substantially vertical slats of the round receptacle, a portion of said angled outside surface being adapted for positioning adjacent a lower portion of the slanted top of the substantially round receptacle and being angled from bottom to top toward the inside of the structural ring, and a portion of said angled outside surface being adapted for positioning adjacent an upper portion of the slanted top of said receptacle and being angled from bottom to top toward the outside of the structural ring, the outside surface of the structural ring being substantially vertically oriented in intermediate portions of the ring substantially ninety degrees from a most inwardly angled portion and a most outwardly angled portion and being intermediately angled in intermediate portions of said rigid structural ring between the most outwardly angled and most inwardly angled and the substantially vertically angled portions of said rigid structural ring, (b) an effective seat comprised of an upwardly directed seating surface of said structural ring for receiving a receptacle cover upon said upwardly directed seating surface of said structural ring, (c) a receptacle cover having an outer bottom configuration matching the seating surface, said cover being secured to the structural ring and having an orifice positioned in the top of said cover of sufficient size to allow convenient passage of refuse and recyclables into the recycling and refuse receptacle upon which the cover is positioned, but small enough to seriously impede removal of such refuse and recyclables from said receptacle and (d) fastening means for securing the rigid structural ring to the inside of the slats of the recycling and refuse receptacle upon which the rigid structural ring is positioned with the differentially angled outside surface of the rigid structural ring in substantial interengagement with the inside surfaces of the slats of the receptacle.

2. A removal lid combination in accordance with claim 1 wherein the upwardly directed seating surface is positioned upon an inwardly extending flange attached to said rigid structural ring.

3. A removable lid combination in accordance with claim 2 wherein the inwardly extending flange is integral with the rigid structural ring forming a rigid structural ring having a generally T-shaped cross section.

4. A removable lid combination in accordance with claim 1 wherein a top surface of a portion of an inwardly extending flange constitutes the effective seat for receipt and support of the receptacle cover.

5. A removable lid combination in accordance with claim 4 additionally comprising a locking means arranged and constructed to interengage with the inwardly extending flange and the receptacle cover to prevent removal of such receptacle cover from the rigid structural ring without recourse to a predetermined unlocking routine.

6. A removable lid combination in accordance with claim 5 wherein at least a portion of the receptacle cover is formed of cast metal.

7. A removal lid combination in accordance with claim 6 wherein the rigid structural ring and receptacle cover are both formed from cast aluminum.

8. A removable lid combination in accordance with claim 7 wherein the fastening means for securing the rigid structural ring to the inside of the slats comprises a series of fastener orifices extending through the rigid structural ring are aligned with fastener orifices in portions of slats of the slanted top slatted receptacle.

9. A removable lid combination in accordance with claim 1 wherein the rigid structural ring has a T-section configuration, an upper portion of which comprises the seat for the receptacle cover and in which fastening orifices for fastening the slats of the receptacle to the rigid structural ring are provided in a lower portion of the T-section below a central web section forming the seat for the receptacle cover.

10. A removable lid combination in accordance with claim 9 wherein fastening means extend through said orifices securing said lower portion of the T-section to the series of receptacle slats arranged about and in contact with the outside of said rigid structural ring.

11. A removable lid combination in accordance with claim 10 wherein the orifice in the top of the receptacle cover is positioned in a lower quadrant of the receptacle cover which is positioned with an inclination with respect to said slats.

12. A removable lid combination in accordance with claim 10 wherein the orifice in the top of the receptacle cover is positioned substantially in the center of said receptacle cover.

13. A removable lid combination in accordance with claim 10 wherein a locking means is positioned in an upper quadrant of the receptacle cover.

14. A removable lid combination in accordance with claim 10 additionally including hooks secured by the fastening means passing through the rigid structural ring and the slats adjacent to the inside of the lower portion of the T-section of the structural ring.

15. A recycling and refuse receptacle comprising:

(a) a series of vertical slats of different lengths formed from a plastic resin composition arranged in substantially a side-by-side circular configuration providing a substantially smoothly slanted top configuration of the top of said receptacle, (b) at least one substantially horizontal ring positioned within the circular configuration of the slats toward a lower portion of said slats and to which the different length slats are attached in a sequence configuration providing said smoothly slanted top, (c) a rigid structural ring positioned above an uppermost ring of the at least one substantially horizontal ring adjacent an upper portion of the slats and having an ovoid configuration with an outer surface having a smoothly curved inclination angled inwardly from bottom to top at a first position on the rigid structural ring, angled outwardly from bottom to top at a second position on the rigid structural ring substantially 180 degrees from the first position, said outside inclination being oriented substantially vertically at right angles to said first and second positions and angled at intermediate inclinations at intermediate positions along the outside of the rigid structural ring, (d) said rigid structural ring being secured to said slats in an inclined orientation by fastening means traversing both the structural ring and the slats, (e) a seat surface positioned upon a top surface of the rigid structural ring, (f) a cover configured for receipt upon the seat positioned upon said top surface of the rigid structural ring, (g) said cover having an orifice disposed through it for receipt of recyclables and refuse, and (h) locking means for locking the cover to the rigid structural ring.

16. A recycling and refuse receptacle in accordance with claim 15 wherein the slats are formed from a strong, durable plastic composition and the rigid structural ring and cover are formed from cast aluminum,

17. A recycling and refuse receptacle in accordance with claim 16 wherein an interior flange of the substantially horizontal ring is positioned adjacent the bottoms of the vertical slats.

18. A recycling and refuse container in accordance with claim 17 wherein there is a further substantially horizontal reinforcing ring secured to the slats at an intermediate position between the rigid structural ring positioned adjacent the top of the slanted top receptacle and the flanged ring adjacent the bottom of the receptacle.

19. A recycling and refuse container in accordance with claim 18 wherein the intermediately positioned horizontal reinforcing ring comprises a circumferential ring having a cylindrical outer surface to which the slats are secured.

20. A recycling and refuse receptacle in accordance with claim 15 wherein the rigid structural ring has a T-shaped cross section an upper surface of a central web of which serves as the seat for the cover and through the lower portion of the outside section of which below the central web extend orifices for the fastening means for securing the rigid structural ring to an upper portion of the slats.

21. A recycling and refuse container in accordance with claim 20 additionally comprising hooks secured to the fastening means mounted in the orifices in the lower portion of the T-section of the rigid structural ring below the central web.

22. A recycling and refuse container in accordance with claim 21 wherein the receptacle cover is provided with two orifices and hooks are secured by suitable fastening means to the bottom of said receptacle cover between said orifices.

23. A recycling and refuse receptacle comprising:

(a) a series of vertical slats of different lengths formed from a plastic resin composition arranged in substantially a side-by-side circular configuration providing a substantially smoothly slanted top configuration at the top of said receptacle, (b) at least one substantially horizontal ring positioned within the circular configuration of the slats toward a lower portion of said slats and to an outer surface of which the slats are attached in a sequence providing said smoothly slanted top configuration, (c) a rigid structural ring having an ovoid configuration with an outer surface having a smoothly curved inclination, said smoothly curved inclination being:

(i) angled inwardly from bottom to top at a first position on the ring (ii) angled outwardly from bottom to top at a second position substantially 180 degrees from the first position on the ring (iii) arranged nearly vertically but with a slight inward inclination from top to bottom at least at two opposite positions with respect to the vertical axis of said receptacle, and (iv) angled at intermediate inclinations at intermediate positions, (d) said structural ring being secured to said slats in an inclined orientation by fastening means traversing both the structural ring and the slats, (e) the substantially horizontal ring also being provided with a slight inward inclination from bottom to top on its outer surface with respect to the vertical axis of said receptacle and aligned vertically with the at least two slight inward inclinations of the outer surface of the rigid structural ring, (f) the vertical slats being drawn securely to the outer surfaces of the rigid structural ring and the substantially horizontal ring by fastening means securing the slats to said structural ring and said horizontal ring such that the slats over the at least two opposite points are provided with a slight inward bow towards the center detectable to at least a careful observer.

24. A recycling and refuse receptacle in accordance with claim 23 wherein the slight inward inclination of the outer surfaces of the rigid structural ring and the horizontal ring are provided at least at the two sides of the receptacle intermediate the highest and lowest positions of the slanted top of the receptacle.

25. A recycling and refuse receptacle in accordance with claim 24 wherein the slight inward inclination of the outer surfaces of the rigid structural ring and the horizontal ring are also provided at the front of the receptacle substantially aligned vertically with the lowest portion of the slanted top of the receptacle.

26. A recycling and refuse receptacle means in accordance with claim 25 wherein the slight inward inclination of the outer surface of the rigid structural ring and the horizontal ring is provided on substantially all outside surfaces of the rigid structural ring and the substantially horizontal structural ring.

27. A recycling and refuse receptacle means in accordance with claim 25 additionally including a plurality of slightly lengthened slats secured with respect to the other slats so that the additional length of said slats extends beyond unlengthened slats on the bottom of the receptacle and provides short supporting legs for the entire receptacle.

28. A recycling and refuse receptacle comprising:

(a) a series of vertical slats of different lengths formed from a plastic resin composition arranged in substantially a side-by-side circular configuration providing a substantially smoothly slanted top configuration of the top of said receptacle, (b) at least one substantially horizontal ring positioned within the circular configuration of the slats toward a lower portion of said slats and to which the different slats are attached in a sequence configuration providing said smoothly slanted top, (c) a rigid structural ring positioned above the substantially horizontal ring and adjacent an upper portion of the slats and having an ovoid configuration with an outer surface having a smoothly curved inclination, said outside surface being:

(i) angled inwardly from bottom to top at a first position on the rigid structural ring, (ii) angled outwardly from bottom to top at a second position on the rigid structural ring substantially 180 degrees from the first position, (iii) arranged with a slight inward inclination from top to bottom at least at two opposite points with respect to the vertical axis of said receptacle, and (iv) angled at intermediate inclinations at intermediate positions along the outside of the rigid structural ring, (d) said rigid structural ring being secured to said slats and retaining them in an overall inwardly bowed orientation by fastening means traversing both the structural ring and the slats.

29. A recycling and refuse receptacle in accordance with claim 28 additionally comprising:

(e) a seat surface positioned upon an upper surface of the rigid structural ring, (f) a receptacle cover configured for receipt upon the seat surfaces positioned upon the upper surface of the rigid structural ring.

30. A recycling and refuse receptacle in accordance with claim 29 additionally comprising:

(g) an orifice disposed in the receptacle cover having a size adapted for receipt of recyclables and refuse.

31. A recycling and refuse receptacle in accordance with claim 29 wherein the slats are formed from a strong, durable plastic composition and the structural ring and receptacle cover are formed from cast aluminum.

32. A recycling and refuse receptacle in accordance with claim 30 wherein the rigid structural ring has a T-shaped cross section the upper surface of a central web forming the leg of the T of which serves as a seat for the receptacle cover and through the lower portion of the outside portion of which below the central web there extend orifices for fasteners for securing the structural ring to an upper portion of the slats.

* * * * *